United States Patent [19]

Russell

[11] Patent Number: 4,607,513

[45] Date of Patent: Aug. 26, 1986

[54] WIRE WORKING MACHINE

[75] Inventor: Frank S. Russell, Northboro, Mass.

[73] Assignee: Sleeper & Hartley Corp., Worcester, Mass.

[21] Appl. No.: 667,219

[22] Filed: Nov. 1, 1984

[51] Int. Cl.[4] ..... B21F 35/02

[52] U.S. Cl. ..... 72/137; 72/131; 72/132; 140/103

[58] Field of Search ..... 72/130, 131, 132, 137; 140/103

[56] References Cited

U.S. PATENT DOCUMENTS

| | | | |
|---|---|---|---|
| 3,351,101 | 11/1967 | Halvorsen et al. | 140/103 |
| 4,372,141 | 2/1983 | Russell et al. | 72/131 |
| 4,416,135 | 11/1983 | Russell | 72/137 |

*Primary Examiner*—Francis S. Husar
*Assistant Examiner*—Jorji M. Griffin
*Attorney, Agent, or Firm*—Wolf, Greenfield & Sacks

[57] ABSTRACT

In a wire working machine particularly one for forming torsion springs, an improvement that enhances the flexibility of the machine. The machine includes a wire former operable at the work station in response to the machine cam shaft and operable over a predetermined forming period. A wire winder is included also operable at the work station and operable in response to the cam shaft over a predetermined winding period. An improved gearing arrangement is provided intercoupling the cam shaft and the wire winder and figured to provide, during a full cam shaft rotation, different intervals of the predetermined forming and winding periods, respectively.

27 Claims, 10 Drawing Figures

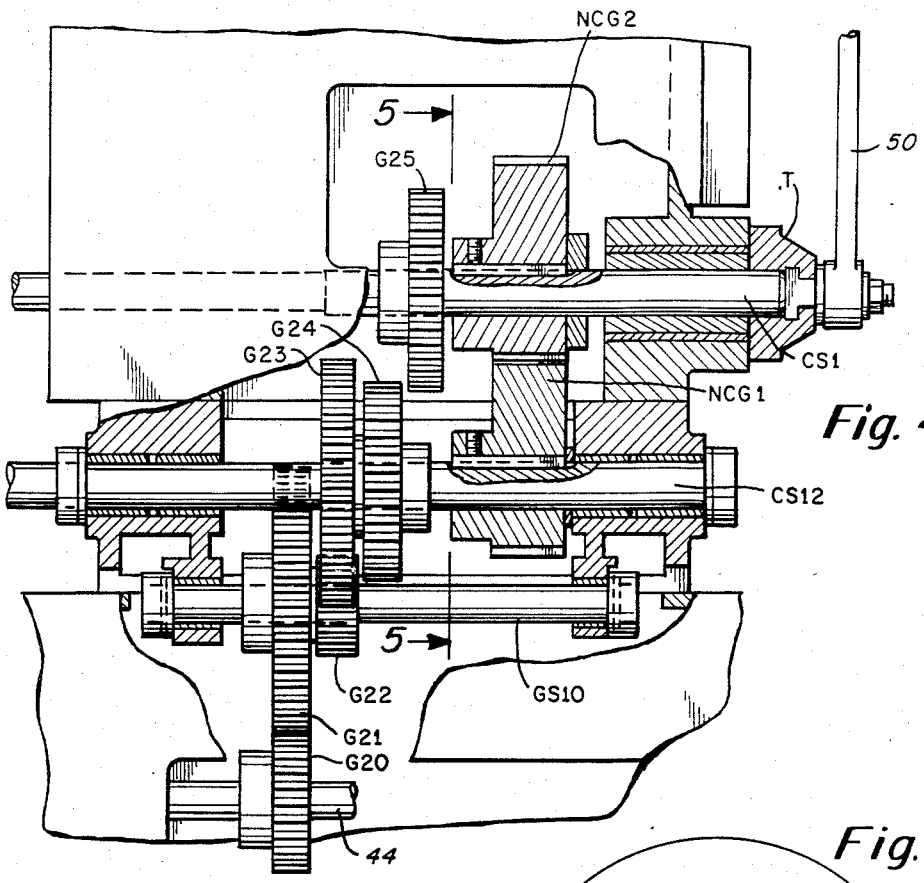
Fig. 4
Fig. 5
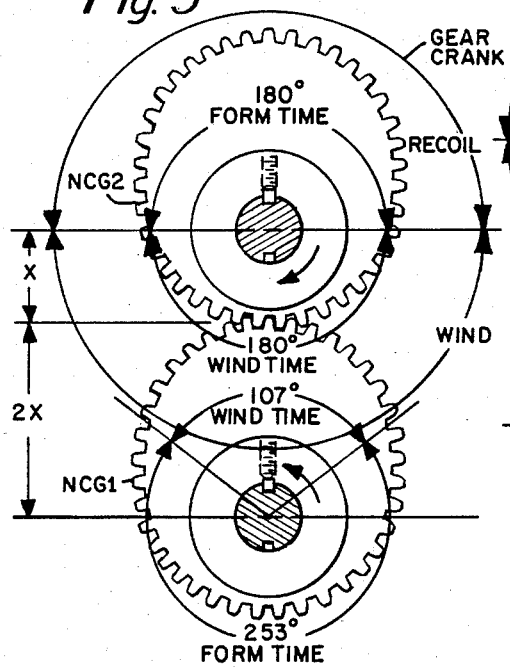
Fig. 6
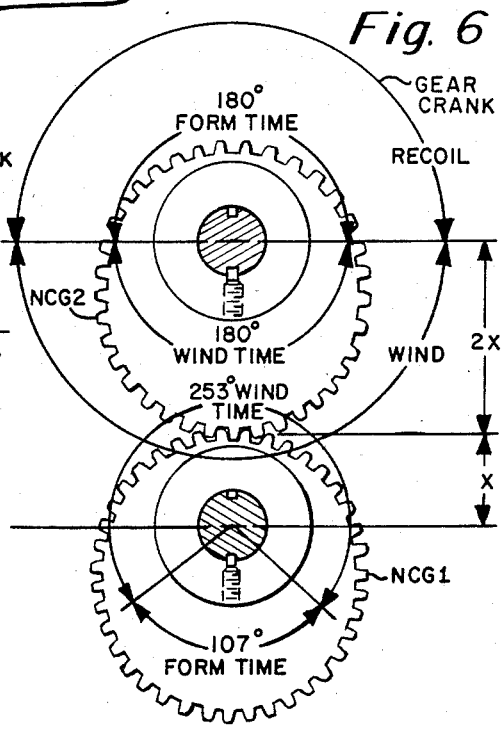

Fig. 8
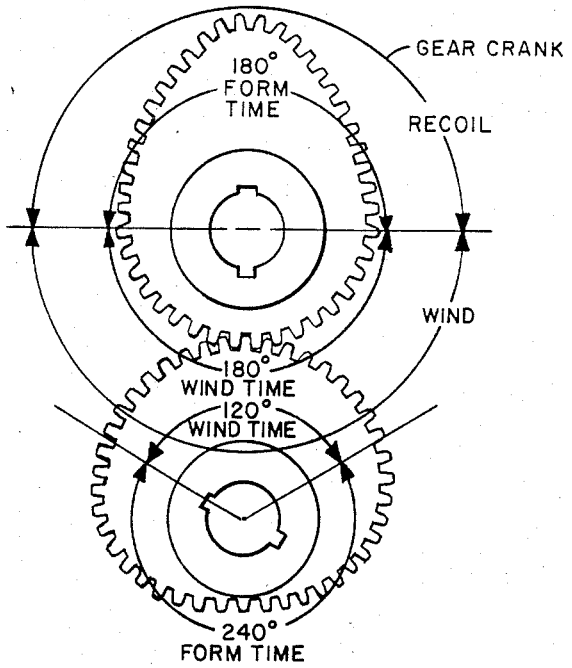
Fig. 9
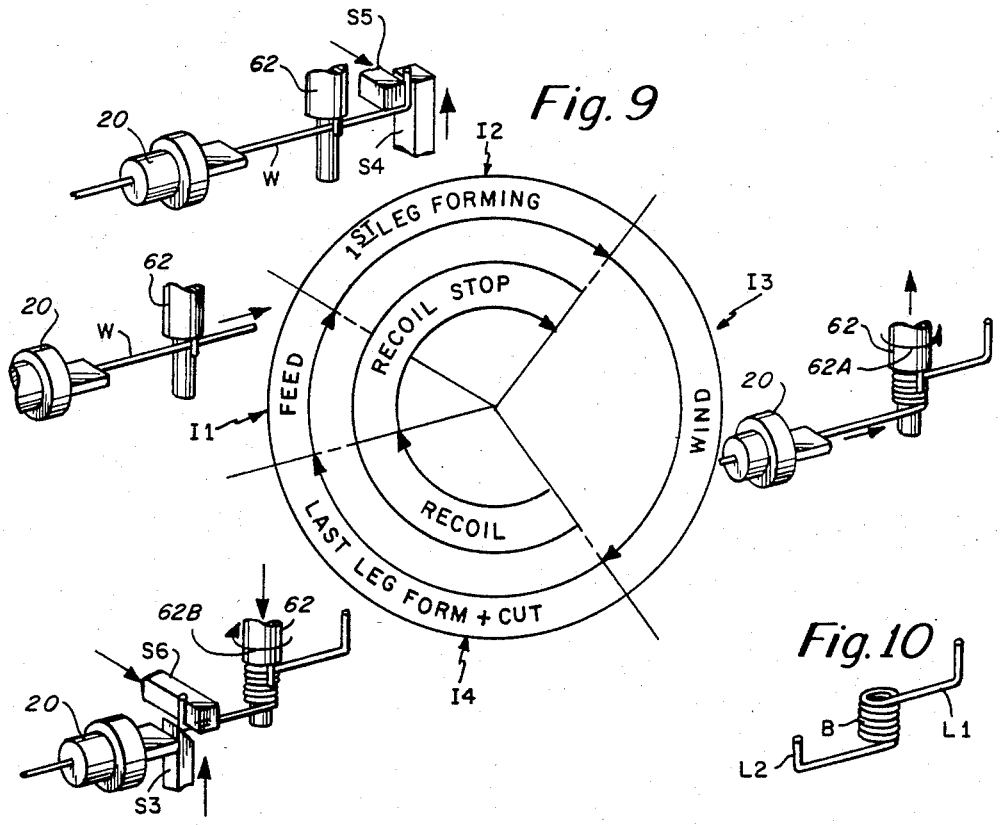
Fig. 10

WIRE WORKING MACHINE

BACKGROUND AND OBJECTS OF THE INVENTION

The present invention relates in general to a wire working machine that may be employed in the construction of torsion springs and in connection with other wire forming operations. More particularly, the present invention pertains to an improvement in wire working machines particularly, duplex wire working machines, providing for improved efficiency in spring forming.

Presently existing wire working or torsion spring forming machines operate on the basis of providing wire forming or feeding steps during 180° of rotation of the main drive shaft or cam shaft, and the winding step is carried out in the other 180° of rotation. See by way of example, our U.S. Pat. Nos. 3,351,101 and 4,416,135. Reference will also be made hereinafter to prior art constructions set forth in FIGS. 1 and 2 herein.

Disadvantages have now been recognized concerning these known machines relating primarily to the fact that due to the equal division of winding and forming-feeding, one is generally limited in the complexity of forming operations that can be carried out with the machine. The existing machines also, due to this form of operation, are limited in the speed of spring making that is attainable.

Accordingly, it is an object of the present invention to provide an improved wire working or torsion spring forming machine that is capable of the construction of more complex spring forming operations.

Another object of the present invention is to provide an improved wire working machine having improved flexibility of operation by virtue of providing control of the duration of respective winding and forming-feeding periods.

A further object of the present invention is to provide an improved wire working machine as in accordance with the preceding object and in which, for a single cam shaft rotation, the forming-feeding time interval is greater than the winding time interval, or alternatively, the winding time interval is greater than the forming-feeding time interval.

Still a further object of the present invention is to provide an improved wire working or torsion spring forming machine that employs non-circular gear means intercoupling the machine cam shaft means with wire winding means so as to provide variable speed wire winding corresponding to constant speed rotation of the cam shaft means.

A further object of the present invention is to provide an improved wire working machine that enables an increase in speed of operation even when constructing relatively complex spring configurations.

PRIOR MACHINES

As indicated previously, one prior wire working machine is described in U.S. Pat. No. 3,351,101. In this patent the speed of wire winding is at a harmonic rate corresponding to a constant speed rotation of the cam shaft. Another patent showing a machine of this general type is a more recently issued U.S. Pat. No. 4,416,135. Also now described herein in FIGS. 1 and 2 is a known machine as presently manufactured and sold by the assignee herein. FIG. 1 is a side elevation view of the machine while FIG. 2 is a view taken along line 2—2 of FIG. 1 showing further details. FIGS. 3–10 describe the improvements in accordance with the present invention which are basically improvements to the machine described in FIGS. 1 and 2. Accordingly, throughout the description that follows, similar reference characters will be employed where parts are correspondingly the same between these machines.

Referring now to FIGS. 1 and 2, the machine comprises a frame that may be considered as being separated into three sections including a base 10, a top section 11, and intermediate section 12. The gear shafts GS1 and GS2, for example, are suitably supported in the top section 11. The cam shafts CS1 and CS2 are generally supported in the intermediate section. Also note the motor M suitably supported in the base 10.

The motor M has an output pulley 38 adapted to drive the belt 40 which in turn drives the pulley 42 secured to the shaft 44. FIGS. 1 and 2 depict this motor drive and also show the cam shafts and gear shafts. At one end of the shaft 44 there is disposed the gear G1 which directly drives the larger gear G2. The gear G2 is fixed to the cam shaft CS1 at one end thereof. At the opposite end of the shaft 44 there is disposed the gear G15 which is intermeshed with the larger gear G16. The gear G16 is supported at an intermediate position on the cam shaft CS2. It is by way of the gears G15 and G16 that the cam shaft CS2 is driven from the input shaft 44. It is also noted that there is provided an electric clutch 46 disposed at an intermediate position on the shaft 44.

The drive to the cam shaft CS1 is by way of gears G1 and G2. Typically, cams are mounted to one end of the cam shaft CS1 at an end remote from the gear G1. These one or more cams may be used in the operation of the tools at the work station WS.

As most clearly illustrated in FIG. 2, the gear G2 has associated therewith a track T which is fixed in position relative to the gear G2. There is provided a connecting arm 50 which may be adjustably positioned in a fixed position along the track T. The top of the arm 50 is connected to the rack R3 and as the gear G2 rotates, the rack is moved in the direction of the arrow 51 shown in FIG. 2. This motion is conveyed to gear G4 on gear shaft GS1 so as to provide rotation of this gear shaft as indicated by the rotating arrow 52.

The gear shaft GS1 also supports at an opposite end, the gear G11 and, at intermediate positions, the gear G5 and the one way clutch 54. The clutch 54 permits rotation of the gear G11 in only one direction. The gear G11 is intermeshed with the gear G12 on a second gear shaft, namely gear shaft GS2.

The gear G5 driven on the gear shaft GS1 controls gears G6-G10. The gear G10 is supported on the friction clutch 56 associated with gear shaft GS2. This gear arrangement provides for selective driving of the bevel gear G14 by way of gears G12 and G13. The shaft 58 from the bevel gear G14 drives the wedge drive member 60. The member 60 has associated therewith a series of stops that can be set for controlling the degree of rotation of this member. It is noted in FIG. 1 that the output of the wedge drive member 60 couples to chuck 61 which in turn holds the winding arbor 62.

FIGS. 1 and 2 also illustrate the feed snubber 32. The snubber 32 moves linearly upon a carriage. The movement is controlled by a mechanical arrangement including arm 82, pivot member 83, and shaft 84. The shaft 84 is connected to bevel gear G18 which in turn is intermeshed with bevel gear G17. This gear arrangement is operated from follower arm 86 depicted in FIG. 2, which in turn is operated from the cam C1 associated with cam shaft CS2. FIG. 2 depicts these components and also shows the direction of movement of most of the members.

As indicated in FIG. 1, on the other end of the cam shaft CS2, remote from the cam C1, there is disposed a set of cams that might include cams C2 and C3. These cams may be used for operating tools used in the forming of the wire. It is typical to have a number of operations as far as forming attachments are concerned. These forming tools are not described in this section of the application in any detail.

With the machine illustrated in FIGS. 1 and 2, for one-half rotation of the cam shaft CS1, the rack R3 is progressing in a direction to enable winding for one half of the cam shaft cycle. For the other half of the cam shaft cycle, the rack R3 is progressing in the opposite direction enabling recoiling as far as the winding is concerned, but moreover enabling forming operations to take place. The gearing is such that both the cam shaft CS1 and the gear shafts GS1 and GS2 are operating at constant relative speeds. Because the winding is accomplished through one half of the rotation cycle, this then leaves only the remaining half for forming and/or feeding tasks.

SUMMARY OF THE INVENTION

Hereinbefore have been set forth objects and advantages of the present invention. In order to accomplish these objectives, there is provided an improved wire working or torsion spring forming machine. This machine comprises a machine frame and feed means supported in the frame and for selectively feeding wire to a work station of the machine. It is at the work station of the machine that certain feeding and forming steps occur along with one or more winding steps for winding the coil of the spring that is being constructed. Cam shaft means are provided, also supported in the frame and driven from a drive source which is typically an electric motor disposed at the base of the machine frame. Wire forming means are provided including means operable at the work station in response to rotation of the cam shaft. This forming means is considered as being operable over a predetermined forming period. There is also provided wire winding means including means operable at the work station in response to cam shaft rotation and operable over a predetermined winding period. Gear means intercouple the cam shaft and wire winding means. This gear means is configured to provide, during a full cam shaft rotation, different intervals of predetermined forming and winding periods, respectively. Thus, in accordance with the improved feature of the present invention, there is provided a greatly enhanced flexibility of the machine by virtue of no longer being limited to 180° of winding and the remaining 180° of forming-feeding. In accordance with the flexibility of the present invention, by the proper selection of the aforementioned gear means, one can provide a longer winding period in comparison with the forming-feeding period or alternatively and preferably one can provide a forming-feeding period that is longer than the winding period. The latter is preferred from the standpoint of enabling the construction of springs having increased forming complexity by carrying out the winding through a segment of rotation of the cam shaft substantially less than 180°, then this leaves a segment of substantially greater than 180° through which to carry out the forming and associated feeding steps. As indicated, this greatly enhances the flexibility of the machine. Alternatively, there may be situations in which the forming is not complex, but one wishes instead to increase the speed of spring making. In this instance, then the winding can take place through a segment greater than 180° rotation of the cam shaft employing the remaining segment for forming, but because the forming is relatively simple, then one is able to increase the speed of operation of the overall machine. Also, this flexibility would be usable in connection with springs that require little forming but substantial amounts of winding.

In accordance with the present invention, the aforementioned gear means preferably comprises non-circular gear means arranged to provide a forming period greater than the winding period in one embodiment herein. The forming period may be at least twice as long as the winding period. In one specific example, the forming period is on the order of 253° of full cam shaft rotation and the winding period is on the order of 107° of full cam shaft rotation. In an alternate arrangement, the gear means may comprise non-circular gear means arranged to provide a winding period greater than the forming period. The winding period may be at least twice as long as the forming period. In one specific example, the winding period is on the order of 253° of full cam shaft rotation and the forming period is on the order of 107° of full cam shaft rotation. The gear means may comprise a pair of elliptical gears or alternatively comprise other non-circular gears that provide the desired operation. With regard to the cam shaft means previously mentioned, this may comprise at least first and second cam shafts, each carrying at least one cam for control of wire forming at the machine work station. There may also be provided a main shaft driven from the drive source and main shaft gears to in turn driving the cam shafts. The feed means may comprise a feed snubber assembly driven from the first cam shaft. The winding means may include second and third gear shafts adapted to transfer drive from the non-circular gears to the means operable at the work station which comprises a winding tool. The gear means that has been mentioned previously actually provides variable speed wire winding drive corresponding to constant speed rotation of the cam shaft. Thus, as the cam shaft rotates through say, one-third of its rotation, the gearing may be provided so that the winding has progressed through an entire winding sequence. During the remaining two-thirds of cam shaft rotation, one thus has available, two-thirds of a total revolution for carrying out forming steps. During this two-thirds of revolution of the cam shaft, of course, the recoiling also may take place.

Also, in accordance with the present invention, there is provided an improved method of forming springs, which method comprises the steps of operating winding means through a period corresponding to less than one-half of rotation of the cam shaft and thereafter in response to continued cam shaft rotation, forming the wire which may include feeding steps, through the remaining interval which is greater than one-half of the full rotation of the cam shaft.

BRIEF DESCRIPTION OF THE DRAWINGS

Numerous other objects, features and advantages of the invention should now become apparent upon a reading of the following detailed description taken in conjunction with the accompanying drawings, in which:

FIG. 4 is a cross-sectional view taken along line 4—4 of FIG. 3 showing further detail of the gearing that is essentially added in accordance with the principles of the present invention to provide desired form of operation;

FIG. 5 is a schematic diagram showing the non-circular gear means of this invention for the case of a forming time of an interval greater than the winding time;

FIG. 6 is a schematic diagram showing the non-circular gear means of this invention for the case of a winding time of an interval greater than the forming time;

FIG. 8 illustrates an alternate form of the non-circular gear means;

FIG. 9 illustrates the sequence of steps carried out in forming a relatively simple spring; and FIG. 10 illustrates the finely formed spring as formed from the sequence of steps of FIG. 9.

DETAILED DESCRIPTION

Figure 1:
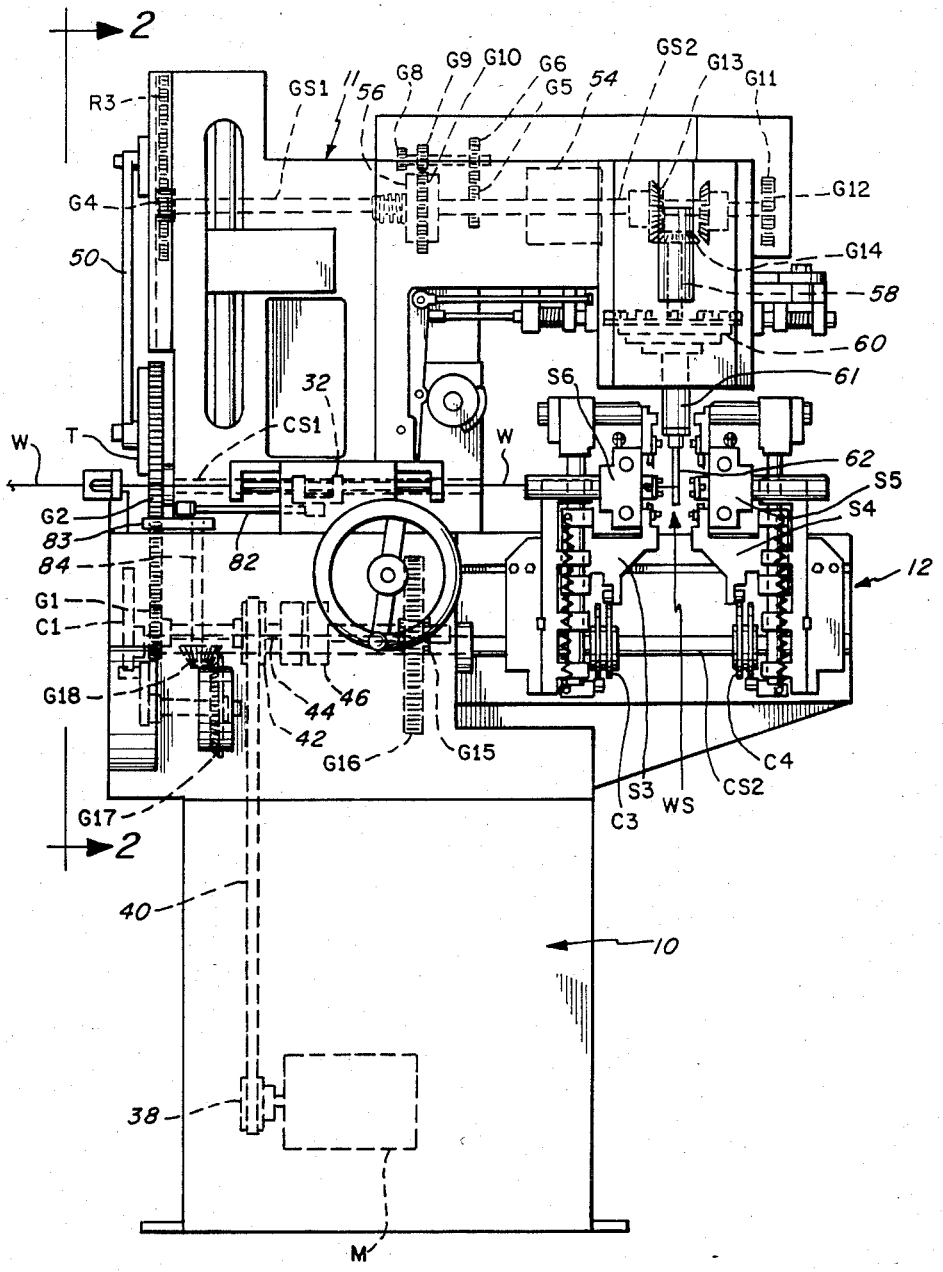
Fig. 1 PRIOR ART
FIG. 1 is a side elevation view of the prior machine.
Figure 2:
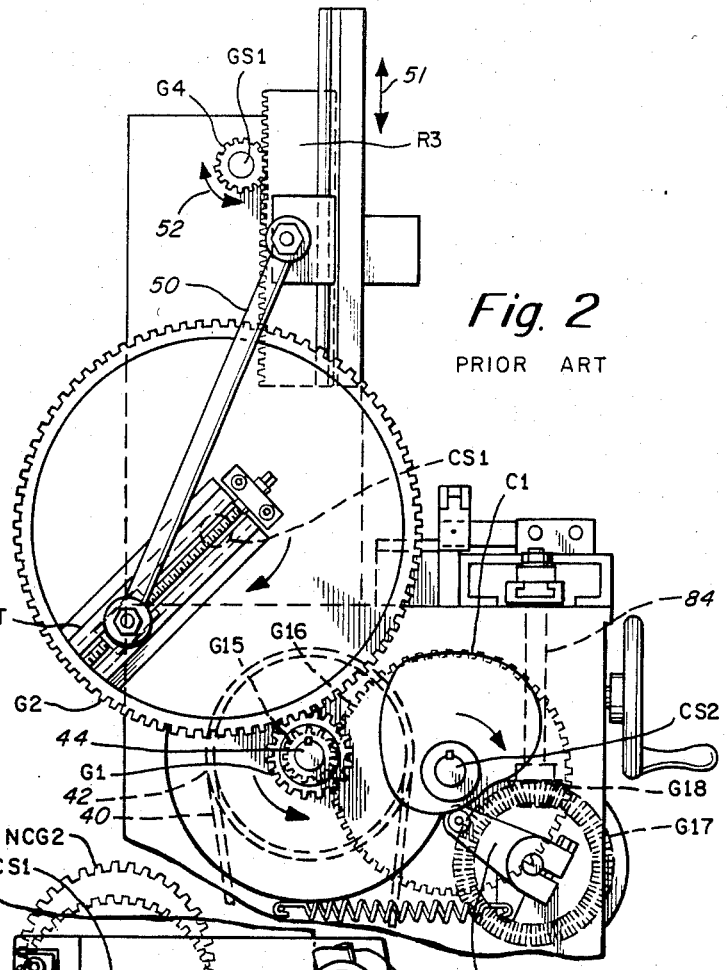
Fig. 2 PRIOR ART
FIG. 2 is a view taken along line 2—2 of FIG. 1 showing further details of this prior machine.
Figure 7:
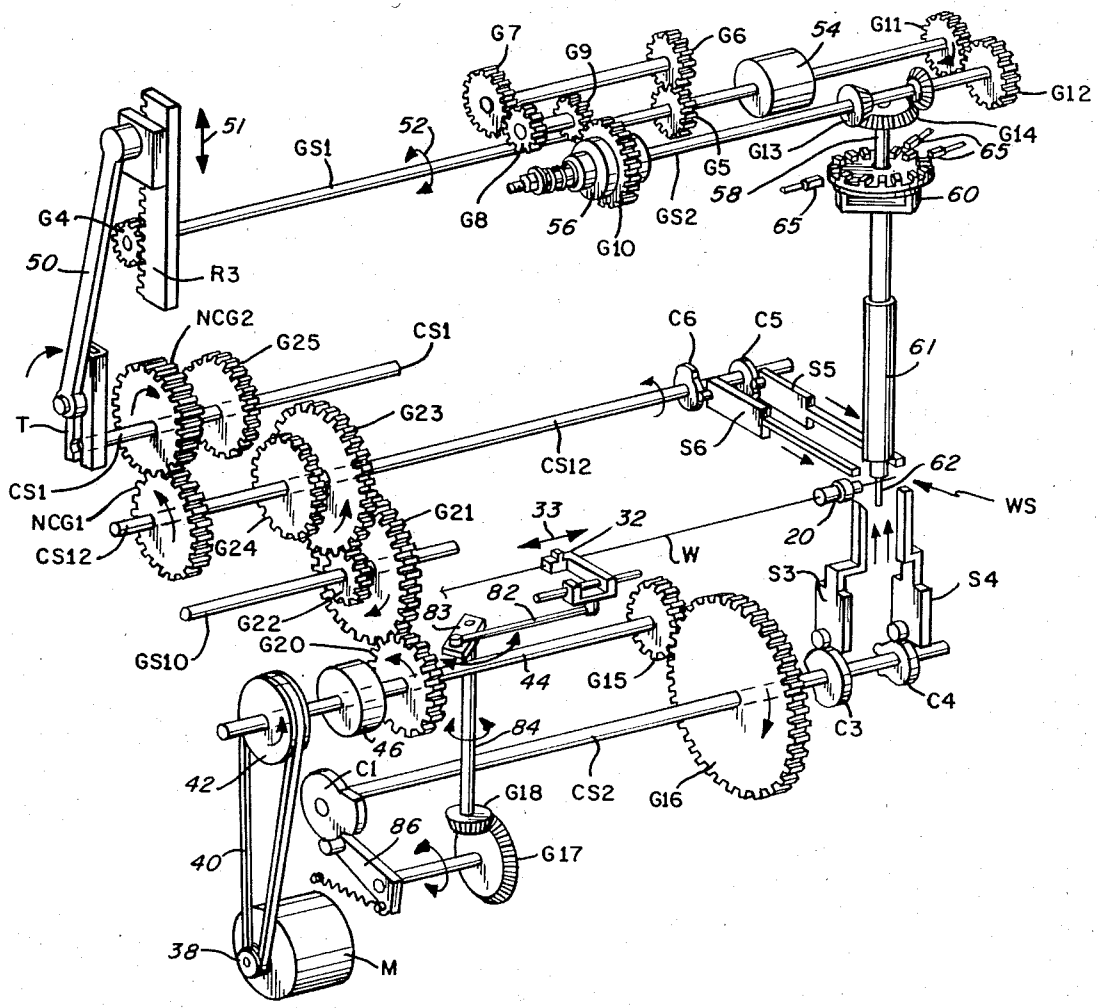
FIG. 7 is a schematic perspective view showing the majority of operative parts of the machine in accordance with the invention including in particular, the gears that are used and associated gear shafts and the operable cams and associated cam shafts along with the feed mechanism and the tools and the like that are provided at the work station.

Reference is now made to FIGS. 3–10 which illustrate a preferred embodiment of the present invention. There is illustrated a wire working machine that comprises a substantial and rugged fame for supporting the various components comprising the machine such as many of the gears and cams along with their associated support shafts. Many of the frame components are not described in detail herein in order to simplify the description. Furthermore, it is understood that these same parts support the various other components of the machine in a substantially known manner. For example, the support of components such as the motor M shown in FIG. 7 is conventional. Moreover, herein the same reference characters are employed to identify similar parts of the machine in comparison to parts previously described in FIGS. 1 and 2. For example, the gear shafts GS1 and GS2 mentioned in FIG. 1 are also for the most part the gears shafts GS1 and GS2 illustrated, for example, in FIG. 7 in connection with the machine of this invention.

Reference may also be made to our earlier U.S. Pat. No. 4,416,135 which describes the general construction of a torsion spring machine. In the embodiment described herein, there is provided an arbor drive for carrying out the coiling or winding functions and there are a series of cams that operate tools at the work station in connection with forming the possibly associated feeding functions.

Figure 3:
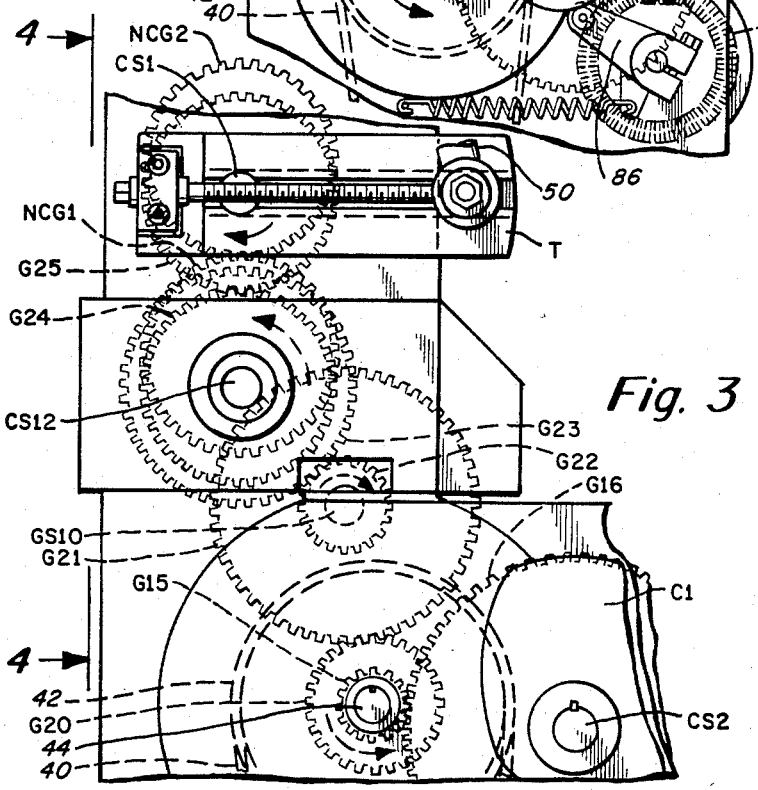
FIG. 3 is a cross-sectional view taken in the same direction as the view of FIG. 2 but now introducing the concepts of the present invention for providing enhanced flexibility of operation as far as control of forming and winding intervals are concerned.

With reference now to the details of the improvement of the invention, in which a reference may now be made to FIGS. 3, 4, and 7. The motor M is mounted in a base of the machine and has associated therewith an output pulley 38 adapted to drive the belt 40 which in turn drives the pulley 42 secured to the shaft 44. Shaft 44 may be considered as the main input drive shaft of the machine. The perspective and schematic view of FIG. 7 depicts the motor drive and also shows the cam shafts and gear shafts. At an intermediate position on the shaft 44,, there is disposed the gear G20 and at one end of the shaft 44 remote from the pulley 42, there is disposed the gear G15. The gear 15 is intermeshed with the larger gear G16. The gear G16 is mounted at an intermediate position on the cam shaft CS2. It is by way of gears G15 and G16 that the cam shaft CS2 is driven from the input shaft 44. Disposed at an intermediate position on the shaft 44 is the electric clutch 46.

The cam shaft CS2 carries cams C1, C3 and C4. The cam C1 is at one end and the cams C3 and C4 are close to each other and at the opposite end of the cam shaft CS2. The cam C1 is for driving the feed snubber 32. The snubber 32 traverses in the direction of the arrow 33 in FIG. 7. For this purpose, the snubber moves upon a carriage. The movement is controlled by a mechanical arrangement including arm 82, pivot member 83, and shaft 84. The shaft 84 is connected to bevel gear G18 which in turn is intermeshed with bevel gear G17. This gear arrangement is operated from follower arm 86 which in turn is operated from the cam C1 of cam shaft CS2. FIG. 7 depicts these components and also shows the direction of movement of most of these components. FIG. 7 also shows the wire W being fed by the feed snubber 32 and extending to the wire guide 20 at the work station WS.

The aforementioned gear G20 on the shaft 44 drives a larger gear G21 mounted on the shaft GS10. In this connection reference may be made to FIG. 4 which shows further details of the support for the gear shafts. Because their support is substantially conventional, it is not described in any detail herein.

On the gear shaft GS10 adjacent to the gear G21, there is supported a smaller gear G22. The gear 22 directly drives gear G23. The gear G23 is supported on the cam shaft CS12. On the cam shaft CS12 adjacent to the gear G23, there is provided a gear G24. The gear G24 is disposed between the gear G23 and the control gear NCG1. The gear NCG1 is one of two matched gears, the other gear being gear NCG2 supported from shaft CS1. The gears NCG1 and NCG2 will be discussed in further detail hereinafter. The cam shaft CS12, like the cam shaft CS2 also supports two cams identified in FIG. 7 as cams C5 and C6. The cams C3 and C4 have associated therewith cam followers in the form of slides S3 and S4, respectively. Similarly, the cams C5 and C6 have associated therewith, cam followers in the form of slides S5 and S6, respectively. It is noted that each of the slides S3–S6 are adapted to move in the direction of the work station for providing certain bending operations on the wire W. In this connection, reference is made hereinafter in FIG. 9 to a sequence of operation involving these slides or forming tools.

As indicated previously, the principle control gears to provide the operation in accordance with the present invention include gears NCG1 and NCG2. The gear NCG2 is disposed on shaft CS1. Also disposed on shaft CS1 is gear G25. In the position of FIG. 4, it is noted that the gear G25 is out-of-mesh with the gear G24. The machine may be designed so that the gears G24 and G25 are brought into mesh, in which case the gears NCG1 and NCG2 are brought out of mesh. This would be in a case wherein one desires to have a 1-to-1 drive between shafts CS1 and CS12.

Reference is also made herein to FIG. 5 which shows the gears NCG1 and NCG2 on their respective shafts. FIG. 5 also illustrates that with this particular elliptical gear arrangement, there is a form time interval of 253° out of the full 360° rotation of the cam shaft. Similarly, there is a wind time interval of 107° out of the full 360° interval. FIG. 5 also shows the dimensional interrelationship between the gears and the manner of support thereof. Note the dimensions X and 2X showing minimum and maximum diameters of each of the gears for providing the form time intervals and wind time intervals described.

As illustrated in FIG. 7, and also in FIGS. 3 and 4, the shaft CS1 has fixedly attached thereto at one end thereof adjacent to the gear NCG2, a linear track T. The track T rotates with the shaft CS1 and supports one end of the connecting arm 50. The connecting arm 50 may be adjustably positioned along the track T at some predetermined fixed location. The top of the connecting arm 50 is connected to the rack R3 and as the shaft CS1 rotates, the rack is moved in the direction of arrow 51 shown in FIG. 7. This motion is conveyed to gear G4 on gear shaft GS1 so as to provide rotation of this gear shaft as indicated by the rotating arrow 52.

The gear shaft GS1 also supports at an opposite end thereof, the gear G11 and, at an intermediate position thereof, the gear G5 and the one way clutch 54. The clutch 54 permits rotation of the gear G11 in only one direction. The gear G11 is intermeshed with the gear G12 on the gear shaft GS2.

The gear G5 driven on the gear shaft GS1 controls gears G6–G10. The gear G10 is supported on the friction clutch 56 associated with gear shaft GS2. This gear arrangement provides for selective driving of the bevel gear G14 by way of gears G12 and G13. The shaft 58 from the bevel gear G14 drives the wedge drive member 60. The member 60 has associated therewith a series of stops 65 for controlling rotation of the wedge drive member 60. The output of the wedge drive member 60 includes a chuck 61 which in turn supports a winding tool such as the winding arbor 62 illustrated in FIG. 7.

In FIG. 5 referred to hereinbefore, the control gears NCG1 and NCG2 are arranged so as to provide a form time interval that is substantially greater than the wind time interval. Alternatively, the gears NCG1 and NCG2 may be arranged on their respective shafts in the manner illustrated in FIG. 6 so as to provide the dual operation providing a wind time interval of say 253° out of a full 360° rotation and a form time interval of 107° out of the total 360° rotation interval. In this regard, note in FIG. 7 that the gears NCG1 and NCG2 are in a position rotated substantially 180° from the position of the gears illustrated in FIG. 5. In FIG. 5 the gears NCG2 and NCG2 are illustrated with their maximum diameter at the top as far as these gears is concerned. In the position of FIG. 7, the rack R3 is at its uppermost position. On the other hand, for the position of FIG. 5, the rack R3 is at an intermediate position and the connecting arm 50 is substantially horizontal. If the gears NCG1 and NCG2 are then reversed through 180° on their respective shafts, with the rack still in the same position, then one has the arrangement of FIG. 6 having the wind time interval substantially greater than the form time interval.

FIG. 8 shows an alternate embodiment for the control gears. In FIG. 8 the gears are not perfectly elliptical. The arrangement of FIG. 8 provides for a wind time interval on the order of 120° and a form time interval on the order of 240°.

FIG. 10 illustrates a spring that can be formed employing the machine of this invention. This spring has a coil body B and end legs L1 and L2. Each of the Legs is bent as illustrated in FIG. 10. In constructing this spring, there are basically four operations that are carried out. These four operations are illustrated in FIG. 9. Each of these separate illustrations in FIG. 9 include a wire guide 20, wire W and the winding arbor 62. FIG. 9 also illustrates a form of timing diagram illustrating the sequence of events. In this connection there are four intervals illustrated as intervals I1, I2, I3, and I4. Interval I1 may be considered as the initial interval and FIG. 9 illustrates therein the wire W being fed so as to engage with the winding arbor 62. The feed of the wire is accomplished by virtue of operation of the cam C1 to operate the feed snubber 32 to advance the wire through the wire guide 20 to the work station. Thereafter, during the forming sequence which incidentally includes intervals I1, I2, and I4, the wire feed ceases and the cams C4 and C5 operate the associated slides S4 and S5 to cause the wire to be bent as illustrated in interval I2 in FIG. 9. This forms the first leg of the spring. This leg is formed by placement of the slide S5 over the wire and then by movement of the slide S4 up to engage and bend the wire. During intervals I1 and I2 it is noted that the arbor 62 is substantially stationary and thus stops are employed in this connection with cease rotation of the wedge member 60 so as to hold the winding arbor stationary.

Next, is the interval I3 during which the winding takes place. Once again, it is noted that this winding interval is substantially less than 180° of rotation. This winding occurs as the cam shaft CS1 rotates and as the rack R3 progresses in its linear progression. FIG. 9 illustrates the winding by the arbor by virtue of the arbor 62 moving in the direction of the arrow 62A.

After the winding sequence has terminated, then interval I4 is commenced. This is the interval during which the last leg of the spring is formed. During this interval it is noted that the rack R3 has progressed to one end of its transition and now starts to move in the opposite direction causing the arbor 62 to then rotate in the opposite direction as indicated by the arrow 62B in FIG. 9. Thus, interval I4 is an interval during which recoiling occurs so that the spring is easily disengaged from the arbor. Also, as indicated previously, the last leg L2 of the spring is formed. This is accompanied by a cutting of the spring. In this regard, it is noted that the slide S3 has a cutting tip at the top thereof which moves upwardly to cut the wire at the outlet side of the wire guide 20. Previously, the slide S6 is engaged to extend over the wire. The action of the slide S3 not only cuts the wire but also bends the wire upwardly as the cutter S3 progresses upwardly. This is illustrated in FIG. 9 by the schematic diagram associated with the interval I4. The spring is now essentially completed and the machine is in readiness for the commencement of a subsequent interval I1 which is the feed interval during which the wire is fed to the arbor.

It is noted that the modification of the torsion spring machine in accordance with the invention can be carried out quite readily so that existing machines are quickly adapted for this improved form of operation. In this connection in FIG. 3 it is noted that an intermediate section can simply be added which includes the shafts GS10 and GS12. These additional gears may add some small cost to the cost of the machine, but the cost is more than offset by the increased versatility.

In accordance with another feature of the present invention, and with reference to FIGS. 4 and 7, the machine of the present invention is constructed so that one can readily change the position of certain gears so that the operation is either in accordance with the ooncepts of the present invention or in accordance with prior machines. As illustrated in FIG. 7, the gears NCG1 and NCG2 are in mesh. However, these gears may be moved out of mesh such as by loosening the gear NCG2 and sliding it along the shaft CS1 so that it is no longer in mesh with the gear NCG1.

Also note in FIG. 4 where these gears NCG1 and NCG2 are shown in mesh. Once these gears are moved out-of-mesh, then the gear 25 may be relocated on the shaft CS1 so that it becomes into mesh with the gear G24. In this regard, note the gears G24 and G25 in FIG. 4. If the gear G25 is moved to the left on its shaft in FIG. 4, then it will mesh with the gear G24. The gear NCG2 can either also be moved so that it is out-of-mesh with the gear NCG1 or could be removed totally from its support shaft.

In actuality, in the embodiment of FIG. 4, when the gear G25 is moved to the left, it appears that there is not a sufficient room for movement of the gear NCG2 out-of-mesh with the gear NCG1. However, by simply displacing the gears slightly further apart, one can easily provide the type of operation that is suggested. This is perhaps more clearly illustrated from FIG. 7 wherein the gear NCG2 has sufficient room to move to the right in that view to disengage from the gear NCG1 while the gear G25 can also move to the right to engage with the gear G24. This movement of the gears can be carried out simply by loosening the gears on their respective shaft and locating them to a different position on the shaft to either provide meshing or non-meshing.

Having described a limited number of embodiments of the present invention, it should now be apparent to those skilled in the art that numerous other embodiments are contemplated as falling within the scope of this invention.

It is noted that there has been described herein a particular set up for constructing one form of a torsion spring. However, the machine of the present invention is adapted for universal operation and can be adapted for making many other types of configurations of wound springs.

What is claimed is:

1. A wire working machine comprising:

a machine frame, feed means supported from the frame and for selectively feeding wire to a work station of the machine, cam shaft means supported from the frame, a drive source for driving said cam shaft means, wire forming means including means operable at said work station in response to said cam shaft means and over a predetermined forming period, wire winding means including means operable at said work station in response to said cam shaft means and over a predetermined winding period, and non-circular gear means intercoupling the cam shaft means and wire winding means configured to provide, during a full cam shaft means rotation, different intervals of the predetermined forming and winding periods, respectively.

2. A wire working machine as set forth in claim 1 wherein said feed means comprises a feed snubber assembly.

3. A wire working machine as set forth in claim 2 wherein said drive source comprises a motor mounted in said machine frame.

4. A wire working machine as set forth in claim 3 wherein said wire forming means includes at least one forming tool.

5. A wire working machine as set forth in claim 4 wherein said wire winding means includes a winding arbor.

6. A wire working machine as set forth in claim 1 wherein said comprises non-circular gear means is arranged to provide a forming period greater than the winding period.

7. A wire working machine as set forth in claim 6 wherein said forming period is at least twice as long as said winding period.

8. A wire working machine as set forth in claim 7 wherein said forming period is on the order of 253° of full cam shaft means rotation, and said winding period is on the order of 107° of full cam shaft means rotation.

9. A wire working machine as set forth in claim 1 wherein said non-circular gear means is arranged to provide a winding period greater than the forming period.

10. A wire working machine as set forth in claim 9 wherein said winding period is at least twice as long as said forming period.

11. A wire working machine as set forth in claim 10 wherein said winding period is on the order of 253° of full cam shaft means rotation, and said forming period is on the order of 107° of full cam shaft means rotation.

12. A wire working machine as set forth in claim 1 wherein said gear means comprises a pair of elliptical gears.

13. A wire working machine as set forth in claim 1 wherein said feed means comprises a snubber feed assembly including bevel gear means.

14. A wire working machine as set forth in claim 1 wherein said cam shaft means comprises at least first and second cam shafts each carrying at least one cam for control of wire forming at the machine work station.

15. A wire working machine as set forth in claim 14 including a main shaft driven from said drive source and main shaft gears for in turn driving said cam shafts.

16. A wire working machine as set forth in claim 15 wherein said feed means comprises a feed snubber assembly driven from said first cam shaft.

17. A wire working machine as set forth in claim 16 wherein said gear means comprises a pair of non-circular gears, one of which is mounted on said second cam shaft.

18. A wire working machine as set forth in claim 17 including a gear shaft for mounting said other non-circular gear.

19. A wire working machine as set forth in claim 18 wherein said wire winding means includes second and third gear shafts adapted to transfer drive from said non-circular gears to said means operable at said work station which comprises a winding tool.

20. A wire working machine as set forth in claim 1 wherein said gear means provides variable speed wire winding means drive corresponding to constant speed rotation of the cam shaft means.

21. A wire working machine as set forth in claim 1 wherein said non-circular gear means comprises a pair of gears, said cam shaft means comprising at least one cam shaft for supporting one of said gears, and a separate gear support shaft for supporting said other gear, said separate shaft providing variable speed wire winding means drive corresponding to constant speed rotation of the cam shaft.

22. A wire working machine as set forth in claim 21 wherein said non-circular gear means comprises elliptical gear means.

23. In a wire working machine having feed means for the wire, a wire forming means operable during a forming period and a wire winding means operable during a winding period, the improvement comprising, non-circular gear means intercoupling a cam shaft of the machine and the wire winding means, said non-circular gear means being configured to provide, during a full cam shaft rotation, different intervals of the predetermined forming and winding periods, respectively.

24. In a wire working machine as set forth in claim 23 wherein said gear means provides variable speed wire winding drive corresponding to constant speed rotation of the cam shaft.

25. A method of forming springs comprising the steps of, feeding wire to a work station, winding and forming the wire, and providing for, in the sequence of forming, a form in the wire whereby the winding of the wire during an interval that is less than the interval allotted to the forming step said winding step performed by use of non-circular gear means operated from cam shaft means and providing, during a full cam shaft means rotation, different intervals of the respective winding and forming periods.

26. In a wire working machine having feed means for the wire, a wire forming means and a wire winding means, the improvement comprising, a gear means intercoupling a cam shaft of the machine and the wire winding means, said gear means including non-circular gear means comprising a first pair of gears adapted to provide, during a full cam shaft rotation, different intervals of the predetermined forming and winding periods, respectively, and circular gear means comprising a second pair of gears only engageable when the first pair of gears are disengaged to provide the same interval for forming and winding periods.

27. In a wire working machine as set forth in claim 26 wherein said non-circular gears comprise elliptical gears.

* * * * *